US005762077A

United States Patent [19]

Griffiths, Jr.

[11] Patent Number: 5,762,077

[45] Date of Patent: Jun. 9, 1998

[54] APPARATUS FOR MANICURING NAILS

[76] Inventor: Valton E. Griffiths, Jr., 2165 66th Ave. South, St. Petersburg, Fla. 33712

[21] Appl. No.: 891,909

[22] Filed: Jul. 14, 1997

[51] Int. Cl.[6] ..... A45D 29/18

[52] U.S. Cl. ..... 132/74.5; 401/18; 206/581; 206/229; 132/318

[58] Field of Search ..... 132/73, 74.5, 75, 132/73.5, 75.3, 75.6, 317, 318, 320, 218, 314; 401/18, 23, 34; 222/325, 129, 551; 206/581, 229; 220/23.4

[56] References Cited

U.S. PATENT DOCUMENTS

| | | | |
|---|---|---|---|
| 1,925,140 | 9/1933 | Gardiner | 132/74.5 |
| 2,458,063 | 1/1949 | Dulberg | 132/314 |
| 2,471,441 | 5/1949 | Moore | 132/314 |
| 3,341,884 | 9/1967 | Pryor | 132/74.5 |
| 3,592,202 | 7/1971 | Jones | 132/314 |
| 3,688,450 | 9/1972 | Brockman | 222/215 |
| 4,156,657 | 5/1979 | Lin | 401/18 |
| 5,655,554 | 8/1997 | Goldberg | 132/314 |

FOREIGN PATENT DOCUMENTS

| | | | |
|---|---|---|---|
| 1416928 | 9/1965 | France | 132/320 |

*Primary Examiner*—Gene Mancene
*Assistant Examiner*—Eduardo C. Robert

[57] ABSTRACT

An apparatus for manicuring nails including a first container that has a front end and a back end. Included is a second container that has a front end and a back end. A back threaded portion of the second container is sized for releasable coupling with the threaded recess wall of the first container. A first end cap has a back end with a projecting cylindrical tip and a solvent applicator. A second end cap has a back end with a projecting cylindrical tip and a polish applicator. Also, a first cap cover is provided and sized for positioning over the first end cap. Lastly, a second cap cover is provided for positioning over the second end cap.

12 Claims, 4 Drawing Sheets

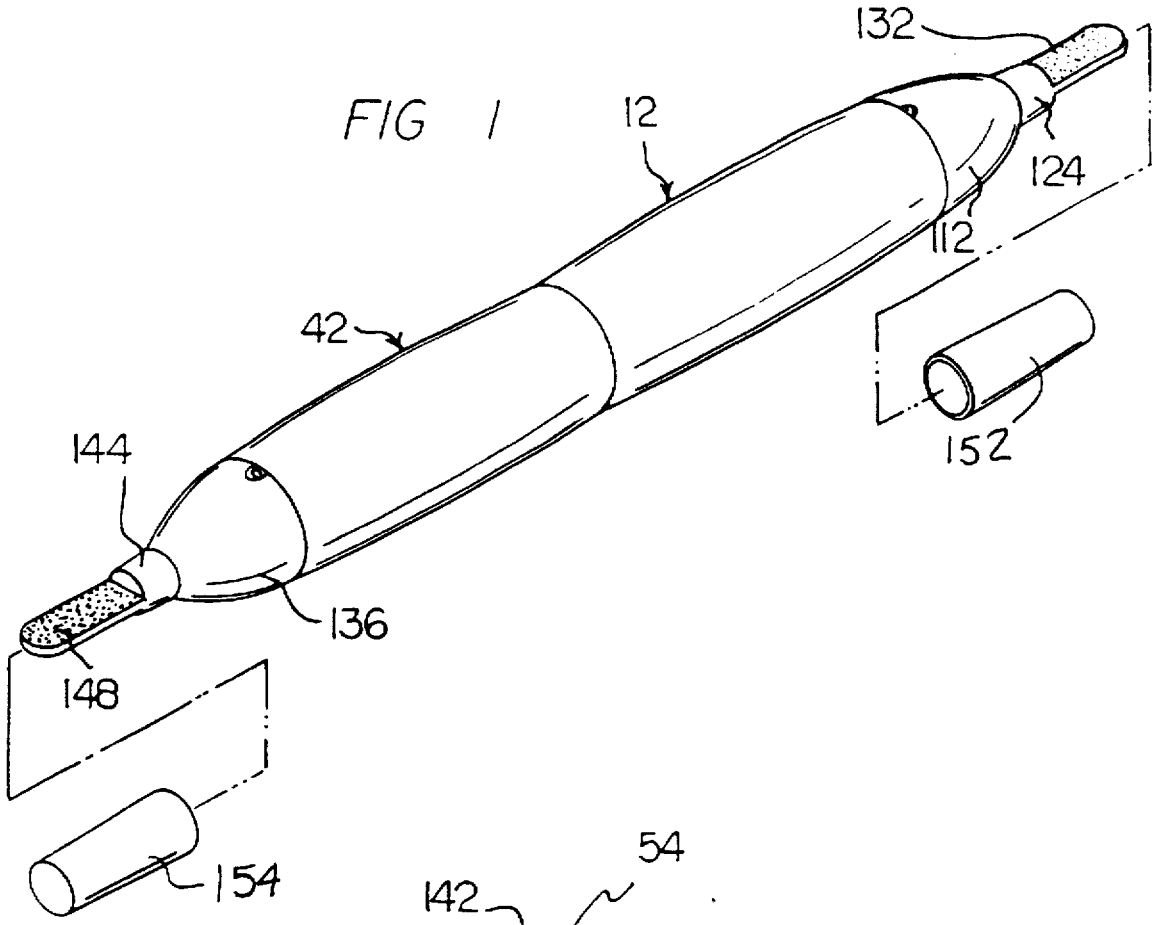
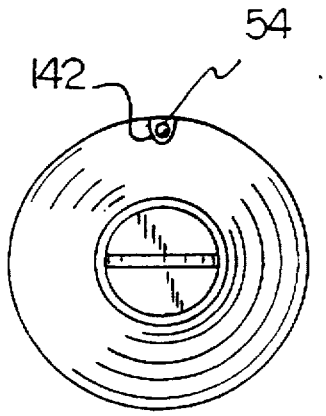
FIG 2

APPARATUS FOR MANICURING NAILS

BACKGROUND OF THE INVENTION

1. Field of the Invention

The present invention relates to an apparatus for manicuring nails and more particularly pertains to providing an apparatus that has a first container filled with solvent and a second container filled with nail polish and further having the containers coupled for ready interchangeable use.

2. Description of the Prior Art

The use of a nail polish applicator is known in the prior art. More specifically, nail polish applicators heretofore devised and utilized for the purpose of containing and applying nail polish are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,154,523 to Devreeze discloses a brush having integrally connected liquid chambers. The brush has a bundle of bristled connected to a handle that is provided with a chamber to be filled with a liquid material.

U.S. Pat. No. 4,932,802 to Cantone discloses a nail polish bottle cover with a nail polish remover dispenser. The nail polish bottle cover has a nail polish remover dispenser incorporated therein. The dispenser consists of a body member that has an elongated neck with a chamber within for holding nail polish remover. A cap is hinged to the top of the body member neck to protect and the top of the nail polish remover applicator when the cap is closed.

U.S. Pat. No. 4,902,152 to Seidler discloses a nail enamel pen. The nail enamel pen has a liquid applicator for applying a liquid to a surface such as a fingernail.

U.S. Pat. No. 4,813,870 to Pitzen and Drake discloses a dispenser for viscous liquids. The dispenser includes a cartridge containing a liquid, a nozzle, and a hollow flexible bladder between the cartridge and the nozzle. The particular dispenser is used by dentist to dispense viscous liquids into opening in teeth being restored.

U.S. Pat. No. 4,854,761 to Smith and Kautman discloses a nail polish remover wand containing disposable pads. The pads are absorbent pads and are stacked into the wand and are driven toward an open end of the wand by selective operator manipulation of the wand.

U.S. Pat. No. 4,712,571 to Remz, Cunningham and Melmik discloses nail polish compositions and means for applying the same. The composition has a low viscosity, i.e. not greater than about 200 cps comprising from about 3% to about 24.0% a shade paste, suitable film former and thinner and a pen-like means for applying the nail polish.

U.S. Pat. No. 4,640,637 to Winthrop discloses an apparatus for dispensing and applying nail polish. The apparatus includes an elongated, hollow housing that has an opening at one axial extremity. A brush is mounted for axial movement between a first position inside the housing and a second position wherein at least a portion of the brush extends out of the housing.

U.S. Pat. No. 4,600,327 to Guzman discloses a writing pen with a correction fluid reservoir. The writing instrument has an ink applicator at one end and a hollow cylindrical reservoir at the opposed end that contains correction fluid.

U.S. Pat. No. 4,599,008 to Furlong and Pike discloses a fingernail polish capsule and plunger. This will be provided as a sealed unit which may be readily placed in a reusable handpiece and wherein there is associated with a cartridge containing the polish, a brush attachment and a plunger.

Lastly, U.S. Pat. No. 3,130,433 to John discloses a manicuring device. The device is used for applying nail polish material to and for removing excess nail polish material from the finger nails.

In this respect, the apparatus for manicuring nails according to the present invention substantially departs from the conventional concepts and designs of the prior art, and in so doing provides an apparatus primarily developed for the purpose of providing an apparatus that has a first container filled with solvent and a second container filled with nail polish and further having the containers coupled for ready interchangeable use.

Therefore, it can be appreciated that there exists a continuing need for a new and improved apparatus for manicuring nails which can be used for providing an apparatus that has a first container filled with solvent and a second container filled with nail polish and further having the containers coupled for ready interchangeable use. In this regard, the present invention substantially fulfills this need.

SUMMARY OF THE INVENTION

In view of the foregoing disadvantages inherent in the known types of nail polish applicator now present in the prior art, the present invention provides an improved apparatus for manicuring nails. As such, the general purpose of the present invention, which will be described subsequently in greater detail, is to provide a new and improved apparatus for manicuring nails which has all the advantages of the prior art and none of the disadvantages.

To attain this, the present invention essentially comprises a first container that is generally cylindrical. The first container has a front end and a back end. The front end has a first neck member extending outwardly therefrom and defining an opening. The first neck member has internal threads and external threads. The back end defining a threaded recess wall extending inwardly from the back end and into a bottom wall. The bottom wall allows the first container to hold an amount of solvent therein. Included is a second container that is generally cylindrical. The second container has a front end and a back end. The front end has a front neck member extending outwardly therefrom and defining an opening. The front neck member has internal threads and external threads. The back end has a back threaded portion extending outwardly therefrom. The back threaded portion is interconnected with a internal bottom wall of the second container. A cylindrical cartridge is positioned within the second container. The cylindrical cartridge sits on bottom wall and holds an amount of nail polish therein. The back threaded portion is sized for releasable coupling with the threaded recess wall of the first container. A first end cap with a generally conical shape is provided. The first end cap has a back end with a projecting cylindrical tip. The first end cap has a solvent applicator positioned within. The solvent applicator has an exterior portion projecting from a top of the first end cap. The projecting cylindrical tip is treaded and sized for releasable coupling with the internal threads of the first neck member of the first container. The projecting cylindrical tip is capable of sealing the solvent within the first container. The solvent applicator is capable of absorbing the solvent and allowing the solvent applicator to be a means for removal of the nail polish from a finger nail. Also, a second end cap is included and has a generally conical shape. The second end cap has a back end with a projecting cylindrical tip. The projecting cylindrical tip is connected with the cylindrical cartridge of the second container. The second end cap has a polish applicator positioned within. The polish applicator has an interior portion projecting from the back end and an exterior portion projecting from a top of the second end cap. The projecting cylindrical tip is treaded and sized for releasable coupling with the internal threads of the front neck member of the second container. The projecting cylindrical tip of the second container is capable of sealing the nail polish within the second container. The polish applicator is capable of absorbing the nail polish when the second end cap is coupled with the second container. The polish applicator serves as a conduit for applying the nail polish from within the second container and onto the finger nail. A first cap cover is sized for positioning over the first end cap. The first cap cover has a first end edge defining a cap opening. The first cap cover has internal threads adjacent the first end edge and capable of coupling with the external threads of the first neck member of the first container. Lastly, a second cap cover is sized for positioning over the second end cap. The second cap cover has a second end edge defining a cap opening. The second cap cover has internal threads adjacent the second end edge and capable of coupling with the external threads of the front neck member of the second container.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved apparatus for manicuring nails which has all the advantages of the prior art nail polish applicators and none of the disadvantages.

It is another object of the present invention to provide a new and improved apparatus for manicuring nails which may be easily and efficiently manufactured and marketed.

It is a further object of the present invention to provide a new and improved apparatus for manicuring nails which is of a durable and reliable construction.

An even further object of the present invention is to provide a new and improved apparatus for manicuring nails which is susceptible of a low cost of manufacture with regard to both materials and labor, and which accordingly is then susceptible of low prices of sale to the consuming public, thereby making such apparatus for manicuring nails economically available to the buying public.

Still yet another object of the present invention is to provide a new and improved apparatus for manicuring nails which provides in the apparatuses and methods of the prior art some of the advantages thereof, while simultaneously overcoming some of the disadvantages normally associated therewith.

Still another object of the present invention is to providing an apparatus that has a first container having a sponge and filled with solvent, and a second container filled with nail polish and further having the containers coupled for ready interchangeable use.

Lastly, it is an object of the present invention to provide a new and improved a first container that has a front end and a back end. The front end has a first neck member and a first protrusion adjacent the first neck member. The back end defining a threaded recess wall extending inwardly into a bottom wall. Included is a second container that has a front end and a back end. The front end has a front neck member and a front protrusion adjacent the front neck member. The back end has a back threaded portion that is interconnected with a internal bottom wall of the second container. The back threaded portion is sized for releasable coupling with the threaded recess wall of the first container. A first end cap has a back end with a projecting cylindrical tip and a solvent applicator positioned within. The projecting cylindrical tip is sized for releasable coupling with the first neck member of the first container. A second end cap has a back end with a projecting cylindrical tip and a polish applicator positioned within. The projecting cylindrical tip is sized for releasable coupling with the front neck member of the second container. Also, a first cap cover is provided and sized for positioning over the first end cap. The first cap cover has a first end edge with a recess that is sized for coupling with the protrusion of the first container. Lastly, a second cap cover is provided and sized for positioning over the second end cap. The second cap cover has a second end edge with a recess that is sized for coupling with the protrusion of the first container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the preferred embodiment of the Apparatus for manicuring nails constructed in accordance with the principles of the present invention.

FIG. 2 is and end view of the present invention in an operable orientation as shown in FIG. 1.

Similar reference characters refer to similar parts throughout the several views of the drawings.

DESCRIPTION OF THE PREFERRED EMBODIMENT

Figure 3:
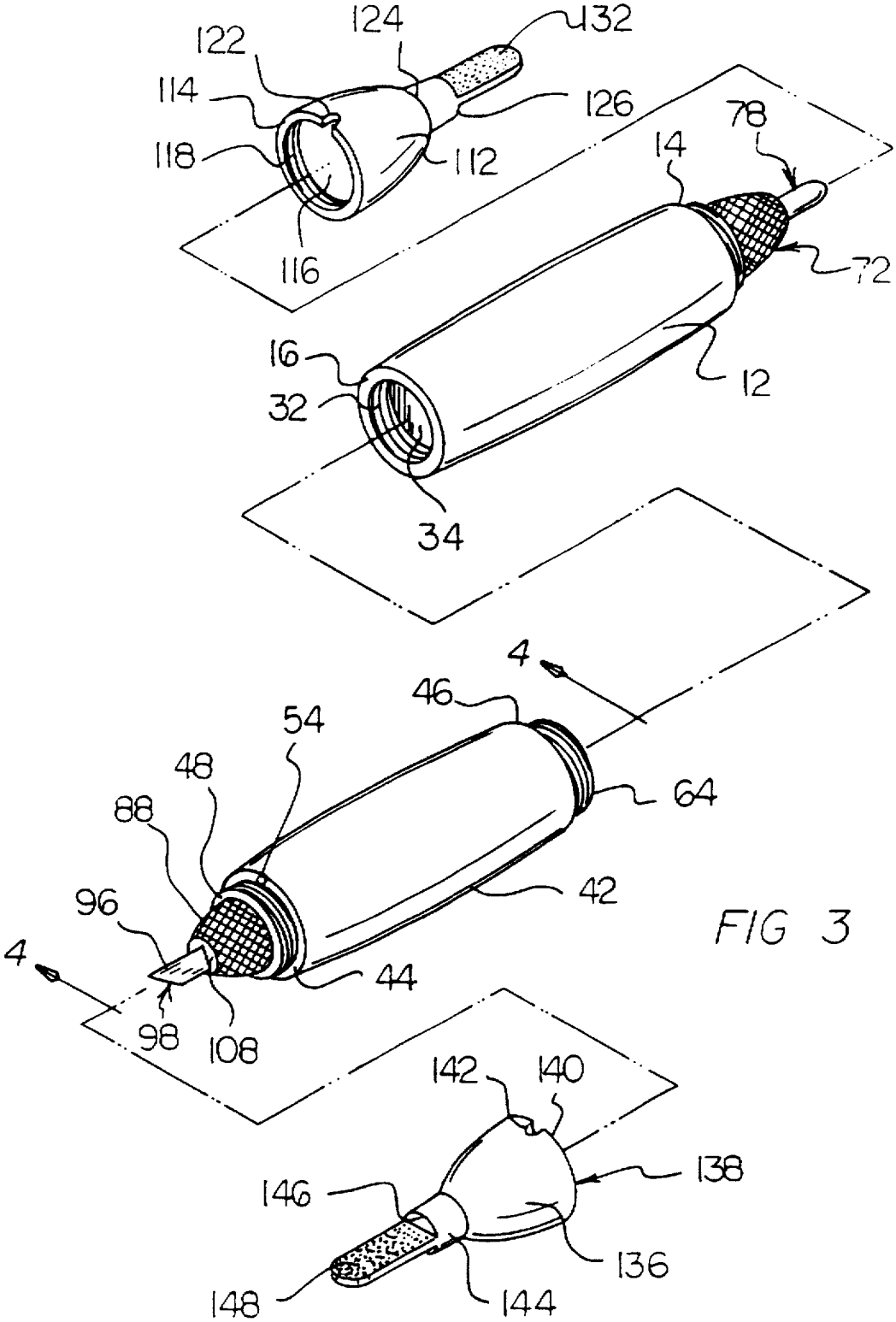
FIG. 3 is an exploded view depicting the operable components of the present invention.

With reference now to the drawings, and in particular to FIG. 1 thereof, a new and improved apparatus for manicuring nails embodying the principles and concepts of the present invention and generally designated by the reference numeral 10 will be described.

The present invention, the new and improved apparatus for manicuring nails, is comprised of a plurality of components. Such components in their broadest context include two containers, two end caps and two cap covers. Such components are individually configured and correlated with respect to each other so as to attain the desired objective.

Figure 5:
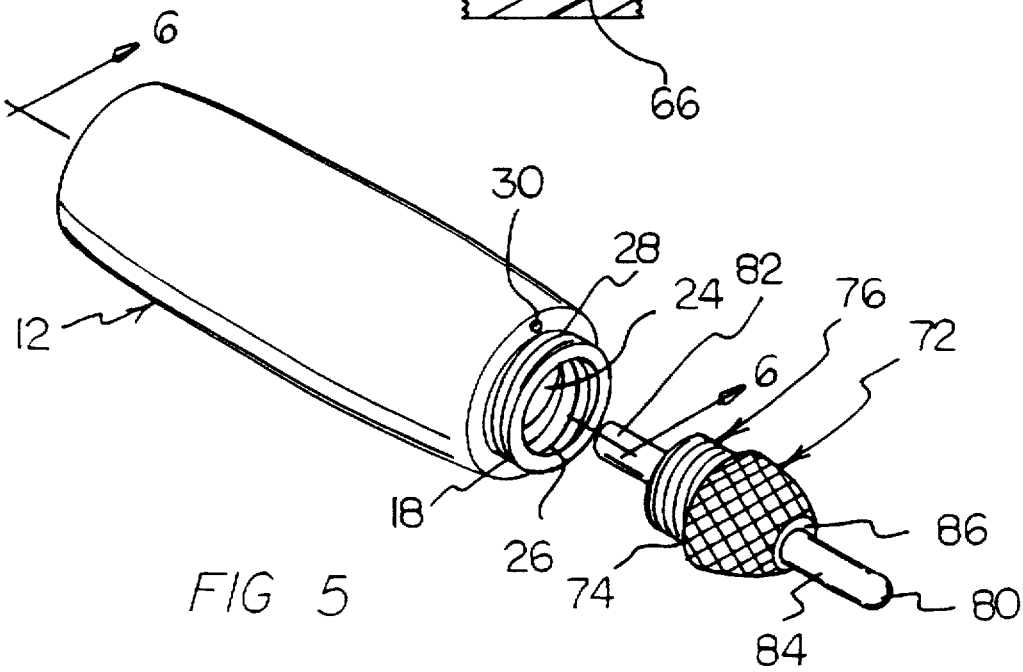
FIG. 5 is an isometric view of the first container in an operable orientation.
Figure 6:
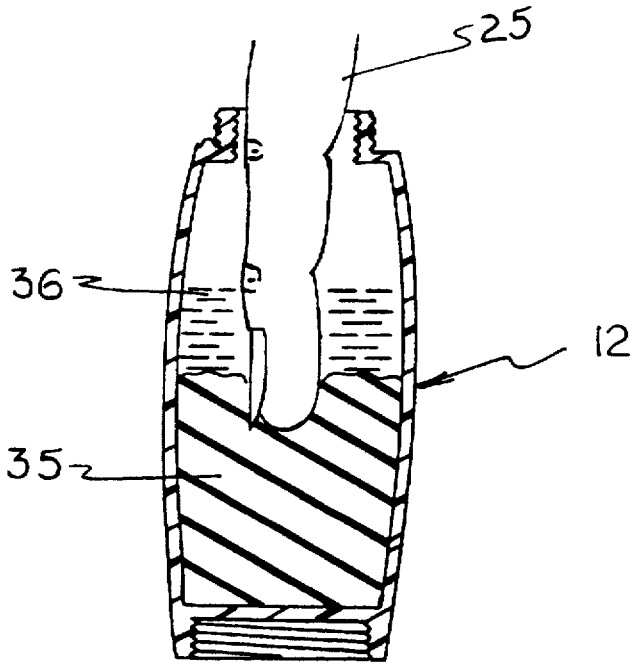
FIG. 6, is a cross-sectional view of the first container taken along line 6—6 of FIG. 5.

More specifically, the present invention includes a first container 12 that is generally cylindrical. As shown in FIG. 3, the first container has a front end 14 and a back end 16. The front end has a first neck member 18 extending outwardly therefrom. The first neck member defines an opening 24, as shown in FIG. 5. The opening is sized to allow any one of the fingers 25 of a hand to be place therethrough. The first neck member has internal threads 26 and external threads 28. The front end of the first container has a first protrusion 30. As depicted in FIG. 3, the back end defines a threaded recess wall 32 extending inwardly from the back end and into a bottom wall 34. The bottom wall allows the first container to hold an amount of solvent. The solvent is any commercially available nail polish remover. As shown in FIG. 6, a sponge 35 and solvent 36 are in the first container. The sponge aids the solvent with the removal of the polish from the finger nail.

Figure 4:
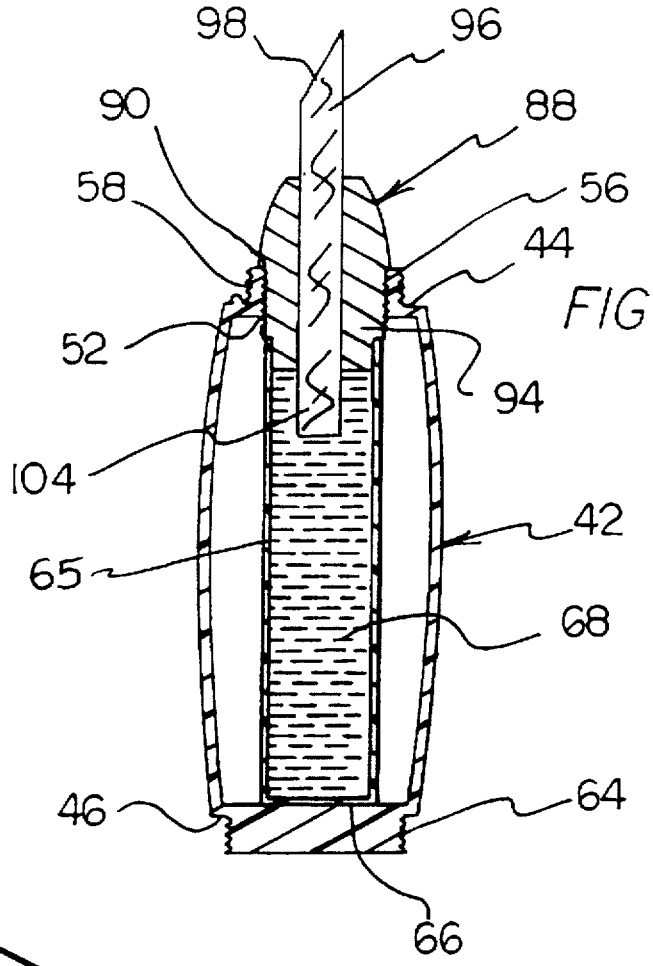
FIG. 4 is a cross sectional view of the second container of the present invention taken along line 4—4 of FIG. 3.

Also, a second container 42 is provided. As shown in FIG. 4, the second container is that is generally cylindrical and has a front end 44 and a back end 46. The front end has a front neck member 48 extending outwardly therefrom and defining an opening 52. The front end of the second container has a front protrusion 54, as shown in FIG. 3. The front neck member has internal threads 56 and external threads 58. The back end has a back threaded portion 64 extending outwardly therefrom. The back threaded portion is interconnected with an internal bottom wall 66 of the second container. A cylindrical cartridge 65 is positioned within the second container. The cylindrical cartridge sits on the bottom wall and holds an amount of nail polish 68 therein and as seen in FIG. 4. The back threaded portion is sized for releasable coupling with the threaded recess wall of the first container 12, as shown in FIG. 1.

The first and second containers are each formed of a molded plastic. The protrusions of each are prefabricated onto each container during the formation process. The containers can be provided in a multitude of colors or in a clear from. The containers are light weight and easy to hold. Each container may be formed with a gripping surface.

As best illustrated in FIG. 3, a first end cap 72 is included. The first end cap has a generally conical shape. The first end cap has a back end 74 with a projecting cylindrical tip 76. The first end cap has a solvent applicator 78, as shown in FIG. 5, that is positioned within and has a rounded tip 80. The solvent applicator is an elongated sponge. The solvent applicator may be used in lieu of dipping the finger into the first container for polish removal. The solvent applicator has an interior portion 82 and an exterior portion 84 projecting from a top 86 of the first end cap. The projecting cylindrical tip is treaded and sized for releasable coupling with the internal threads 26 of the first neck member 18 of the first container. The projecting cylindrical tip is capable of sealing the solvent within the first container 12. The exterior surface of the first end cap is texturized to assist with gripping the first end cap when using the first container. The solvent applicator absorbs the solvent and allows the solvent applicator to be a means for removal of the nail polish from a finger nail. Removal of the first end cap allows the first container 12 to be refilled with solvent once the first container becomes empty.

Additionally, a second end cap 88 is provided, as shown in FIG. 4. The second end cap has a generally conical shape and is coupled with the cylindrical cartridge 65. The second end cap has a back end 90 with a projecting cylindrical tip 94. The projecting cylindrical tip is connected to the cartridge. The second end cap has a polish applicator 96 positioned within and having a tapered tip 98. The polish applicator has an interior portion 104 projecting from the back end and an exterior portion 106 projecting from a top 108 of the second end cap. As shown in FIG. 4, the projecting cylindrical tip is treaded and sized for releasable coupling with the internal threads 56 of the front neck member 48 of the second container. The projecting cylindrical tip of the second container, when coupled with the cylindrical cartridge, is capable of sealing the nail polish 68 within the second container. The polish applicator, when in contact with the nail polish, will absorb the nail polish when the second end cap is coupled with the second container. The polish applicator serves as a conduit for applying the nail polish from within the cylindrical cartridge of the second container and onto the finger nail. Removal of the second end cap allows the cylindrical cartridge to be removed. A new cylindrical cartridge is placed within the second container for refilling the second container with nail polish once the polish is exhausted. In the alternative, the nail polish could be placed within the second container and the entire second container could be replaced when the polish is exhausted.

A first cap cover 112, as seen in FIG. 1, is sized for positioning over the first end cap 72. The first cap cover has a first end edge 114 that defines a cap opening 116. The first cap cover has internal threads 118 adjacent the first end edge and a recess 122. The first cap cover has a first cylindrical extent 124 projecting outwardly from a second end 126. The cylindrical extent has a first file member 132 interconnected and extended outwardly therefrom. The first cap cover couples with the external threads of the first neck member 18 of the first container to protect and store the first end cap. Once the first cap cover is twisted around the first neck member, the recess will engage the first protrusion with a snap coupling. The coupling of the protrusion and recess will lock the first cover cap about the first end cap.

Lastly, a second cap cover 136, as shown in FIG. 1, is sized for positioning over the second end cap 88. The second cap cover has a second end edge 138 defining a cap opening 140. The second cap cover has internal threads identical to the internal threads 118 of the first cap cover. The internal threads of the second cap cover are adjacent the second end edge and a recess 142. As shown in FIG. 5, the second cap cover has a second cylindrical extent 144 projecting outwardly from a second end 146. The second cylindrical extent has a second file member 148 interconnected and extending outwardly therefrom. The second cap cover couples with the external threads 58 of the front neck member of the second container, as shown in FIG. 2.

Each cap cover is hollowed out so as to allow it to fit over its respective end cap with out fear of damage to the applicators. The cap are made of a molded plastic and the file member have emery board adhered to there surface. The file board can come in a variety of textures.

Furthermore, the first file member 132 and the second file member 148 are each protected with a cover 152 and 154. The cover of each snap fits around the cylindrical extent of each cap cover.

The present invention apparatus for manicuring nails is structured to provide the use one apparatus that will do the entire job. The first and second containers are self contained and can be joined or separated during use. The user will not need to have several separate different utensils to manicure their finger nails. This one apparatus will file, polish and remove unwanted polish.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved apparatus for manicuring nails comprising in combination:

a first container being generally cylindrical and having a front end and a back end, the front end having a first neck member extending outwardly therefrom and defining an opening, the first neck member having internal threads and external threads, the back end defining a threaded recess wall extending inwardly from the back end and into a bottom wall, the bottom wall allowing the first container to hold an amount of solvent therein;

a second container being generally cylindrical and having a front end and a back end, the front end having a front neck member extending outwardly therefrom and defining an opening, the front neck member having internal threads and external threads, the back end having a back threaded portion extending outwardly therefrom, the back threaded portion being interconnected with a internal bottom wall of the second container, a cylindrical cartridge being positioned within the second container, the cylindrical cartridge sits on bottom wall and holds an amount of nail polish therein, the back threaded portion being sized for releasable coupling with the threaded recess wall of the first container;

a first end cap having a generally conical shape and a back end with a projecting cylindrical tip, the first end cap having a solvent applicator positioned within, the solvent applicator having an exterior portion projecting from a top of the first end cap, the projecting cylindrical tip being treaded and sized for releasable coupling with the internal threads of the first neck member of the first container and capable of sealing the solvent within the first container, the solvent applicator being capable of absorbing the solvent and allowing the solvent applicator to be a means for removal of the nail polish from a finger nail;

a second end cap having a generally conical shape and a back end with a projecting cylindrical tip, the projecting cylindrical tip being connected with the cylindrical cartridge of the second container, the second end cap having a polish applicator positioned within, the polish applicator having an interior portion projecting from the back end and an exterior portion projecting from a top of the second end cap, the projecting cylindrical tip being treaded and sized for releasable coupling with the internal threads of the front neck member of the second container and capable of sealing the nail polish within the second container, the polish applicator being capable of absorbing the nail polish when the second end cap is coupled with the second container, the polish applicator serving as a conduit for applying the nail polish from within the second container and onto the finger nail;

a first cap covers being sized for positioning over the first end cap, the first cap cover having a first end edge defining a cap opening, the first cap cover having internal threads adjacent the first end edge and capable of coupling with the external threads of the first neck member of the first container; and a second cap cover being sized for positioning over the second end cap, the second cap cover having a second end edge defining a cap opening, the second cap cover having internal threads adjacent the second end edge and capable of coupling with the external threads of the front neck member of the second container.

2. An apparatus for manicuring nails comprising:

a first container having a front end and a back end, the front end having a first neck member and a first protrusion adjacent the first neck member, the back end defining a threaded recess wall extending inwardly into a bottom wall;

a second container having a front end and a back end, the front end having a front neck member and a front protrusion adjacent the front neck member, the back end having a back threaded portion being interconnected with a internal bottom wall of the second container, the back threaded portion being sized for releasable coupling with the threaded recess wall of the first container;

a first end cap having a back end with a projecting cylindrical tip and a solvent applicator positioned within, the projecting cylindrical tip being sized for releasable coupling with the first neck member of the first container;

a second end cap having a back end with a projecting cylindrical tip and a polish applicator positioned within, the projecting cylindrical tip being sized for releasable coupling with the front neck member of the second container;

a first cap cover being sized for positioning over the first end cap and having a first end edge with a recess being sized for coupling with the protrusion of the first container; and a second cap cover being sized for positioning over the second end cap and a second end edge with a recess being sized for coupling with the protrusion of the second container.

3. The apparatus for manicuring nails as set forth in claim 2, wherein the first neck member extending outwardly from the front end of the first container and defining an opening.

4. The apparatus for manicuring nails as set forth in claim 2, wherein the first neck member of the first container having internal threads and external threads and the front neck member of the second container having internal threads and external threads.

5. The apparatus for manicuring nails as set forth in claim 2, wherein the bottom wall of the first container allows the first container to hold an amount of solvent.

6. The apparatus for manicuring nails as set forth in claim 2, wherein the front neck member of the second container extending outwardly from the front end of the second container and defining an opening.

7. The apparatus for manicuring nails as set forth in claim 2, wherein the internal bottom wall allowing the second container to hold an amount of nail polish.

8. The apparatus for manicuring nails as set forth in claim 2, wherein the solvent applicator having an exterior portion projecting from a top of the first end cap.

9. The apparatus for manicuring nails as set forth in claim 8, wherein the first end cap is capable of sealing the solvent within the first container so as to allow the solvent applicator to absorbing the solvent and providing a means for removal of the nail polish from a finger nail.

10. The apparatus for manicuring nails as set forth in claim 2, wherein the polish applicator having an interior portion projecting from the back end and an exterior portion projecting from a top of the second end cap.

11. The apparatus for manicuring nails as set forth in claim 10, wherein, the polish applicator being capable of absorbing the nail polish when the second end cap is coupled with the second container, the polish applicator serving as a conduit for applying the nail polish from within the second container and onto the finger nail.

12. The apparatus for manicuring nails as set forth in claim 2, wherein the second end cap is capable of sealing the nail polish within the second container.

* * * * *